US007367490B2

(12) United States Patent
Forthaus et al.

(10) Patent No.: US 7,367,490 B2
(45) Date of Patent: May 6, 2008

(54) CONTAINER FOR SHIPPING AND STORING PAPER

(75) Inventors: Christopher G. Forthaus, Naperville, IL (US); George I. Nukuto, Des Plaines, IL (US); Scott Belliveau, Plainfield, IL (US); Dale J. Waite, Nampa, ID (US); James L. Pfaffendorf, Salem, OR (US)

(73) Assignee: Boise White Paper, L.L.C., Boise, ID (US)

( * ) Notice: Subject to any disclaimer, the term of this patent is extended or adjusted under 35 U.S.C. 154(b) by 503 days.

(21) Appl. No.: 10/655,643

(22) Filed: Sep. 5, 2003

(65) Prior Publication Data

US 2004/0124234 A1 Jul. 1, 2004

Related U.S. Application Data

(60) Provisional application No. 60/417,109, filed on Oct. 8, 2002.

(51) Int. Cl.
*B65D 5/46* (2006.01)
*B65D 75/58* (2006.01)

(52) U.S. Cl. ..... 229/117.24; 206/215; 206/738; 229/122; 229/123; 229/193

(58) Field of Classification Search ..... 229/117.15, 229/117.24, 122, 123, 193, 194, 117.22, 117.23; 206/215, 449, 738
See application file for complete search history.

(56) References Cited

U.S. PATENT DOCUMENTS 275,578 A * 4/1883 Brown ..... 206/215
522,237 A * 7/1894 Sexton ..... 229/123
659,238 A * 10/1900 Killinger ..... 229/117.13
1,149,805 A * 8/1915 Barrabee ..... 229/117.24
1,600,260 A 9/1926 Walter
1,731,414 A * 10/1929 Grossman ..... 229/117.15
1,950,934 A * 3/1934 Shearer ..... 229/114
2,191,723 A * 2/1940 Mulnix ..... 229/117.15
2,880,866 A 4/1959 Van Dyck
3,306,516 A 2/1967 Taylor
3,542,281 A * 11/1970 Field et al. ..... 229/117.24
D243,663 S 3/1977 Booth
4,269,348 A * 5/1981 Young ..... 229/117.14
4,308,995 A * 1/1982 Hanes ..... 229/117.15

(Continued)

OTHER PUBLICATIONS

The Wiley Encyclopedia of Packaging Technology, John Wiley & Sons, pp. 66-69 (1986).*

*Primary Examiner*—Gary E Elkins
(74) *Attorney, Agent, or Firm*—Klarquist Sparkman, LLP

(57) ABSTRACT

A container for shipping and/or storing a stack of paper is disclosed. The container, according to a disclosed embodiment, comprises a bottom wall and first and second upright, opposing side walls extending from respective edges of the bottom wall. First and second shell portions are connected in a pivotal manner to respective edges of the bottom wall. The shell portions are pivotable toward and away from each to close and open the container, respectively. When the container is closed, the stack is securely contained between the shell portions and the side walls for shipping or storing. When the container is opened, at least two opposing sides of the stack are exposed to facilitate removal of paper from the container. A handle for carrying or lifting the container may be coupled to one of the shell portions.

30 Claims, 10 Drawing Sheets

U.S. PATENT DOCUMENTS

| | | | | |
|---|---|---|---|---|
| 4,317,536 | A | 3/1982 | Dickerson | |
| 4,318,505 | A * | 3/1982 | Cordell, Jr. | 229/117.14 |
| 4,325,482 | A | 4/1982 | Feeser | |
| D280,491 | S | 9/1985 | Nielsen | |
| 4,583,681 | A * | 4/1986 | Neese | 229/117.22 |
| D315,098 | S | 3/1991 | Hutcheson | |
| 5,042,715 | A * | 8/1991 | McNeill | 229/117.15 |
| D328,863 | S | 8/1992 | Van Druff, Jr. | |
| 5,499,764 | A | 3/1996 | Carlsson | |
| D393,422 | S | 4/1998 | Pecher | |
| 5,779,048 | A | 7/1998 | Dunn | |
| 5,779,049 | A | 7/1998 | Werby et al. | |
| 5,794,770 | A | 8/1998 | Plomgren et al. | |
| D402,554 | S | 12/1998 | Batchelor | |
| 5,871,102 | A * | 2/1999 | Lambert | 206/738 |
| D421,219 | S | 2/2000 | Roemer et al. | |
| 6,073,760 | A | 6/2000 | Roemer et al. | |
| D486,390 | S | 2/2004 | Auclair et al. | |

* cited by examiner

CONTAINER FOR SHIPPING AND STORING PAPER

CROSS-REFERENCE TO RELATED APPLICATION

The present application claims the benefit of U.S. Provisional Application No. 60/417,109, filed on Oct. 8, 2002, which is incorporated herein by reference.

FIELD

The present invention relates to packaging, and more particularly, to containers for packaging cut sheets of paper.

BACKGROUND

Corrugated containers for accommodating loose sheets of paper are well-known. The side walls of known containers are formed to substantially define the dimensions of the sheets of the paper packed therein to prevent movement of the loose sheets within the container, and thereby minimize damage to the edges of the sheets. Typically, such containers are provided with either a removable lid or a lid that is hingedly secured to the container to permit access to the paper through an open top. However, since there is little clearance between the sheets and the side walls, it is difficult to remove the paper without tilting or inverting the container to cause the paper to slide out through the open container top. This causes the edges of the paper sheets to misalign as they slide out from the container and sometimes results in folding and/or tearing of sheets, particularly the edges. Any damage to the paper edges can adversely affect the runability performance when it is loaded into a printing or photocopying device. In addition, if paper misalignment occurs, an operator of the printing/photocopying device must orderly stack the loose paper sheets, with all the edges of the sheets in alignment, so that the sheets can be properly loaded into the printing device.

In another configuration of a conventional paper container, access to the paper is provided by a side wall that is pivoted downwardly to expose one side of the paper stack. This requires using one hand to remove paper from the container, which limits the amount of paper a user can easily remove from the container in an orderly fashion.

In addition, current paper containers typically use a plastic strap and/or an adhesive strip to keep the container closed during shipping and handling. This structure requires additional expense and effort. In some cases, box cutters or scissors must be used to open the container to remove the paper.

Accordingly, there exists a need for a new and improved container for packaging cut sheets of paper.

SUMMARY

It is therefore an object of the present invention to provide a container for shipping and/or storing a stack of paper that permits easy access to the paper for removing it from the container.

To such ends, and according to one representative embodiment, a container for containing a stack of paper comprises a bottom wall having opposed first and second edges. The bottom wall is dimensioned to support a stack of paper placed thereon. A first shell portion is pivotally connected at a bottom edge thereof to the first edge of the bottom wall, and a second shell portion is pivotally connected at a bottom edge thereof to the second edge of the bottom wall. The first and second shell portions are pivotable between a closed position for containing the stack of paper for shipping or storing, and open position, in which the top and at least two opposing sides of the stack are exposed. Advantageously, the shell portions, when opened, enable a user to easily remove the desired amount of paper from the container by grasping the paper on opposing sides of the stack.

In particular embodiments, the first shell portion comprises a main panel pivotally connected at a bottom edge thereof to the first edge of the bottom wall, a top panel extending from a top edge of the main panel, and first and second, spaced apart side panels. Each side panel extends from a respective side edge of the main panel, and is rigidly secured to the top panel and the main panel. Similarly, the second shell portion comprises a main panel pivotally connected at a bottom edge thereof to the second edge of the bottom wall, a top panel extending from a top edge of the main panel, and first and second, spaced apart side panels. Each side panel of the second shell portion extends from a respective side edge of the main panel, and is rigidly secured to its respective top panel and main panel. With this configuration, when the shell portions are closed, the top panels of the shell portions extend in an overlapping relationship relative to each other to serve as the top of the container, and the main panels extend upwardly from the bottom wall to serve as opposing side walls of the container. In addition, each side panel of the first shell portion extends in an overlapping relationship with an adjacent side panel of the second shell portion, thereby forming opposing side walls of the container extending between the main panels.

The container also may include first and second internal side walls, or panels, extending upwardly from respective edges of the bottom wall, each being positioned in a face-to-face relationship with an adjacent side of the stack. When the shell portions are closed, the internal side walls are positioned internal to the shell portions, and each side panel of the first shell portion extends in an overlapping relationship with an adjacent side panel of the second shell portion and an adjacent internal side wall. In this manner, the internal side walls serve to provide additional structural rigidity to the sides of the container formed by the overlapping side panels of the shell portions. Also, the internal side walls desirably are pivotally connected to the bottom wall so that when the shell portions are opened, the side walls can be pivoted downwardly away from the stack to expose all four sides of the stack.

In addition, the container may be provided with a handle to facilitate carrying of the container. In one embodiment, the handle is coupled to the top panel of the first shell portion, and the top panel of the second shell portion is formed with a corresponding opening for receiving the handle. Thus, when the shell portions are closed, with the top panel of the second shell portion overlapping the top panel of the first shell portion, the handle extends upwardly through the opening. Advantageously, the handle in this configuration assists in retaining the shell portions in the closed position. Desirably, the handle is positioned to be at the geometric center of the top of the container when the container is closed to permit gravity-centered lifting and carrying of the container with one hand.

According to another representative embodiment, a container for containing one or more articles comprises a bottom wall, first and second shell portions connected in a pivotal manner to opposing edges of the bottom wall, and a handle coupled to one of the first and second shell portions.

The shell portions are pivotal between a closed position in which the shell portions substantially enclose the articles and an open position in which the articles are exposed at least at two opposing sides of the container to facilitate removal of articles from the container.

According to still another representative embodiment, a container for containing one or more articles comprises a bottom and first and second side walls extending upwardly from respective edges of the bottom, with the first side wall being opposite the second side wall. In addition, first and second shell portions are connected in pivotal manner to respective edges of the bottom. The shell portions are pivotable toward each other to a closed position to contain the articles therebetween for shipping or storing the stack. The shell portions are also pivotable away from each other to cause the container to be open at two opposing sides of the container to facilitate removal of articles from the container.

A container for containing one or more articles, according to another representative embodiment, comprises a bottom, a first shell portion having a main panel connected in pivotal manner to a respective edge of the bottom, and a second shell portion having a main panel connected in pivotal manner to a respective edge of the bottom. Each shell portion has a top panel extending from a top edge of its respective main panel and first and second side panels extending from respective side edges of its respective main panel. The shell portions are pivotable toward each other to a closed position with the articles contained between the main panels, the top panels extending in an overlapping relationship relative to each other to cover the top of the articles, and each side panel of the first shell portion at least partially overlapping an adjacent side panel of the second shell portion and an adjacent side wall. The shell portions are also pivotable away from each other to cause the container to be open at the top and two opposing sides of the container to facilitate removal of articles from the container.

According to another representative embodiment, a blank for forming a container for containing paper comprises a bottom panel dimensioned to support a stack of paper, a first shell portion extending from an edge of the bottom panel, and a second shell portion extending from an edge of the bottom panel, opposite the first shell portion. The shell portions are configured such that, when the container is formed from the blank, the shell portions are pivotable relative to the bottom panel between a closed position for containing the stack of paper for shipping or storing and open position, in which at least two opposing sides of the stack are exposed to facilitate removal of paper from the container.

The foregoing and other features and advantages of the invention will become more apparent from the following detailed description of several embodiments, which proceeds with reference to the accompanying figures.

DETAILED DESCRIPTION

Figure 4:
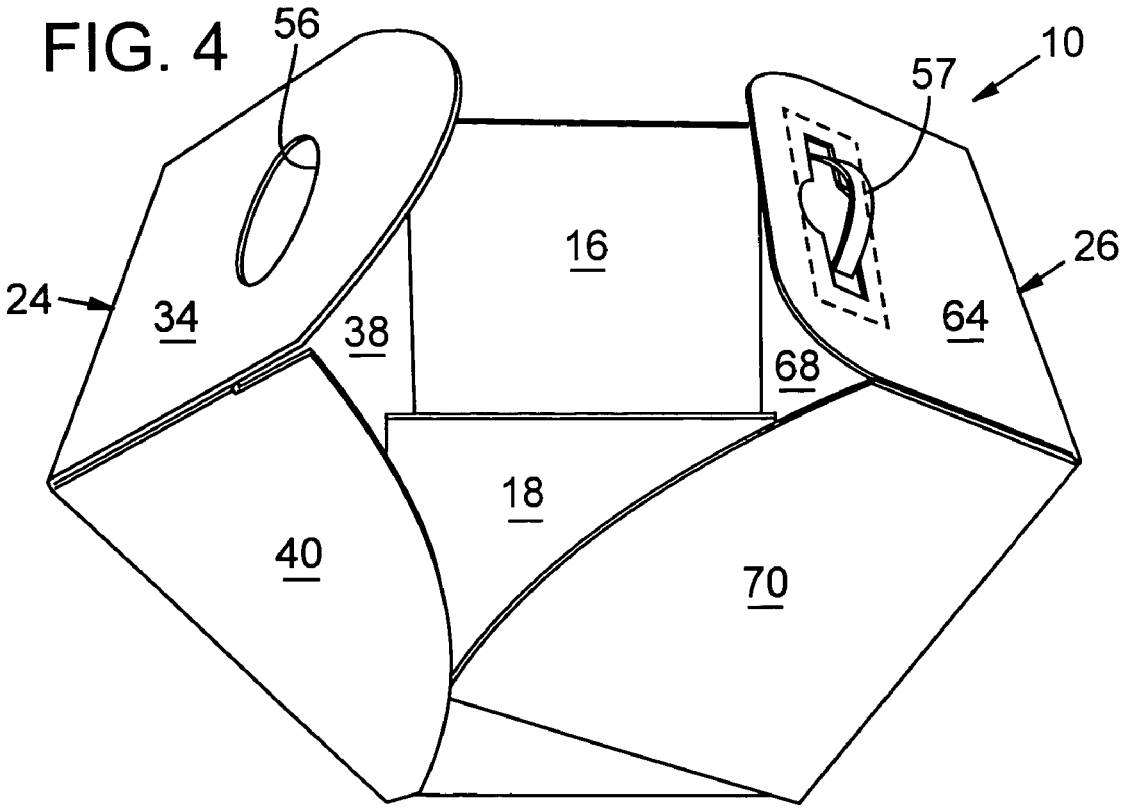
FIG. 4 is a perspective view of the container of FIG. 1, shown with the shell portions partially separated.
Figure 5:
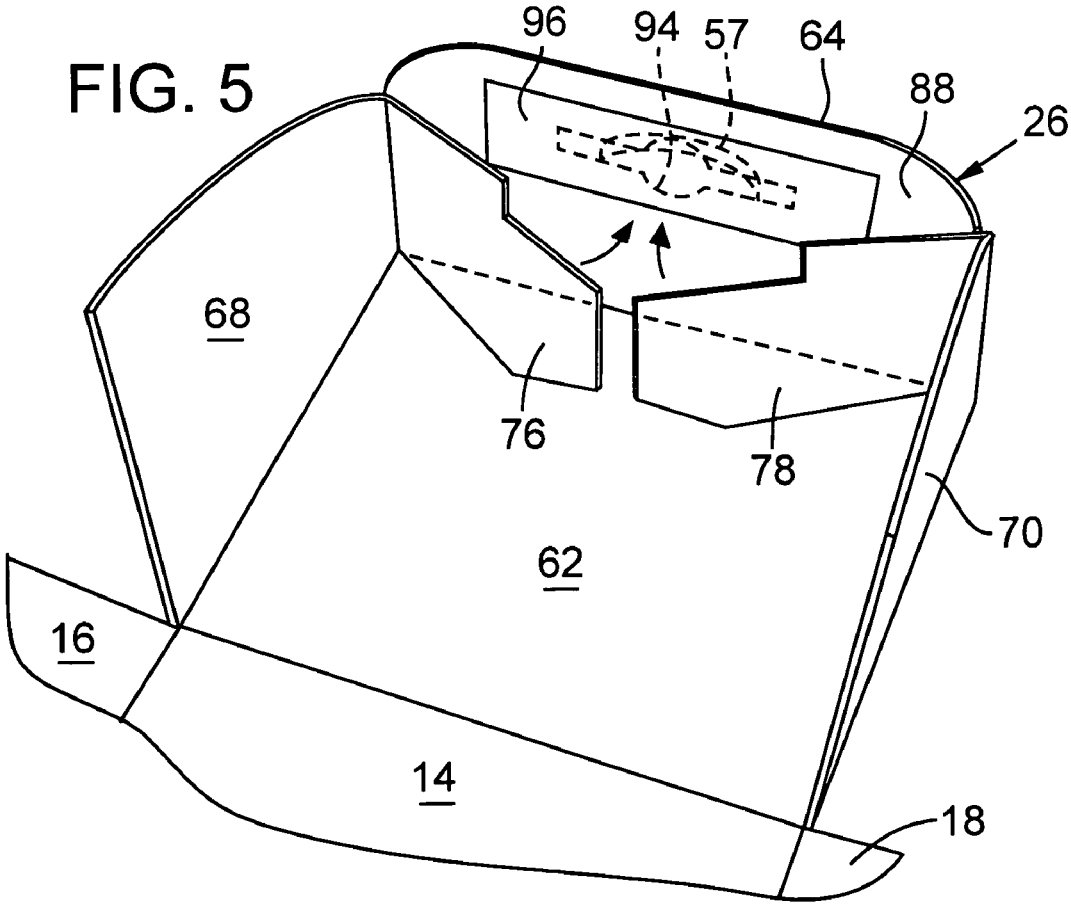
FIG. 5 is a perspective view illustrating assembly of one of the shell portions of the container of FIG. 1.
Figure 6:
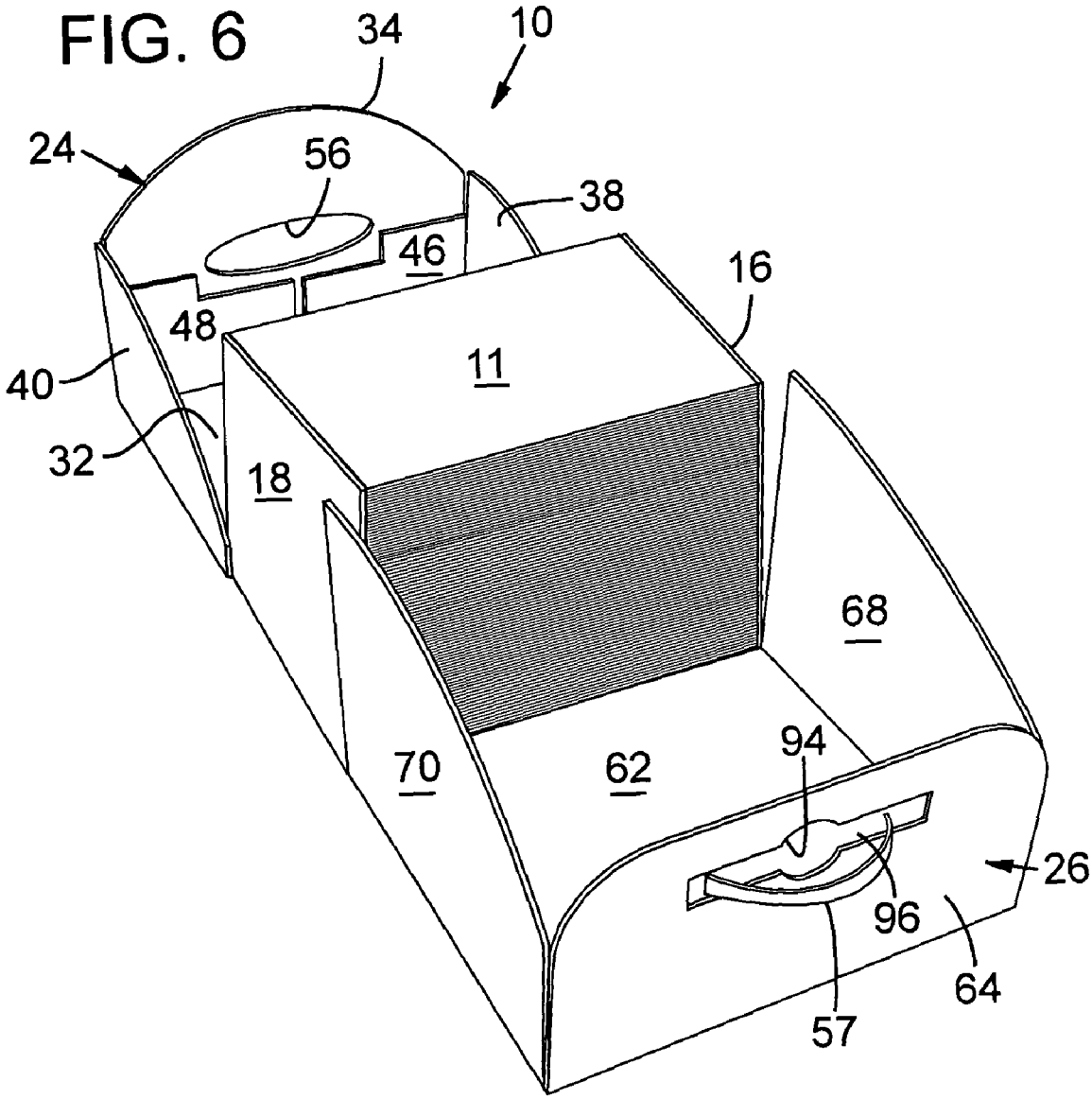
FIG. 6 is a perspective view similar to FIG. 2, showing a stack of loose paper sheets positioned in the opened container.

Referring to the drawings, a container according to one embodiment is indicated generally at 10 in FIGS. 1-2 and 4-6. In this configuration, the container 10 is generally rectangular for containing a stack 11 of cut sheets of paper (FIG. 6). In a working embodiment, the container 10 is dimensioned to hold about 2,500 sheets of paper (5 reams). The container 10 could, of course, have a shape other than rectangular, such as substantially square or other shape selected to contain, but not damage, paper products. Moreover, container 10 also could have dimensions selected to hold a greater or lesser amount of paper. Container 10 can be used either to store or ship a stack of loose paper sheets (as shown in FIG. 6) or individually wrapped reams of paper. Further, the container 10 can have dimensions selected to hold multiple stacks of paper placed side-to-side or end-to-end, or a stack of vertically oriented paper (i.e., a stack of paper supported on edge).

Of course, if desired, the container 10 could be used to store or ship articles other than paper, such as toys, produce, and various other articles. In one implementation, for example, one or more sides of the container 10 may include an opening or window covered by a transparent material (e.g., cellophane plastic) for use as a toy box. In another implementation, the container 10 can include an internal liquid-tight liner (such as used in boxes for storing and dispensing wine) so that the container can be used to hold liquids.

Figure 1:
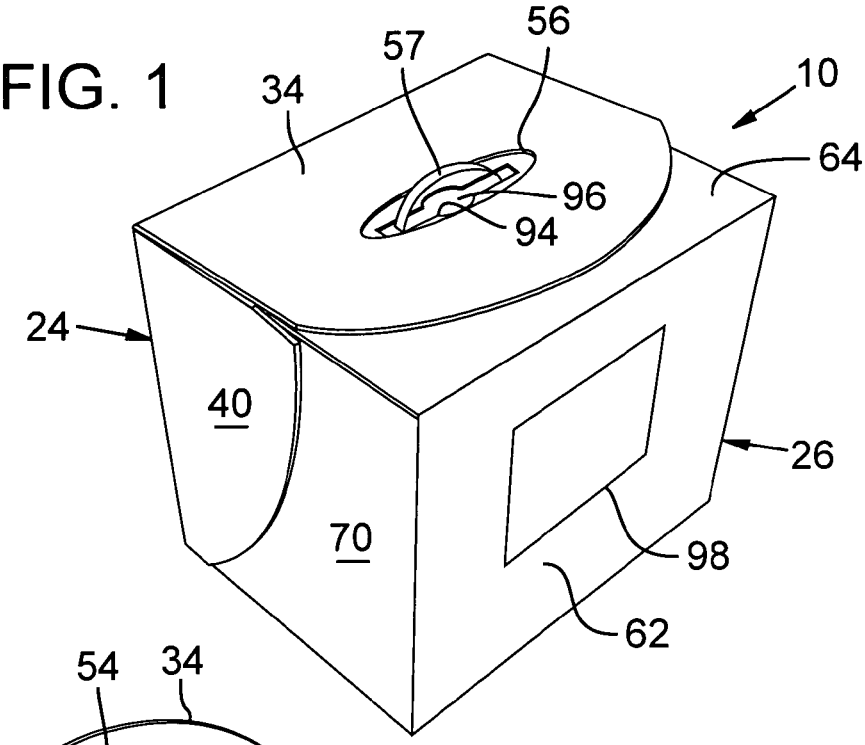
FIG. 1 is a perspective view of a closed container according to one representative embodiment.
Figure 2:
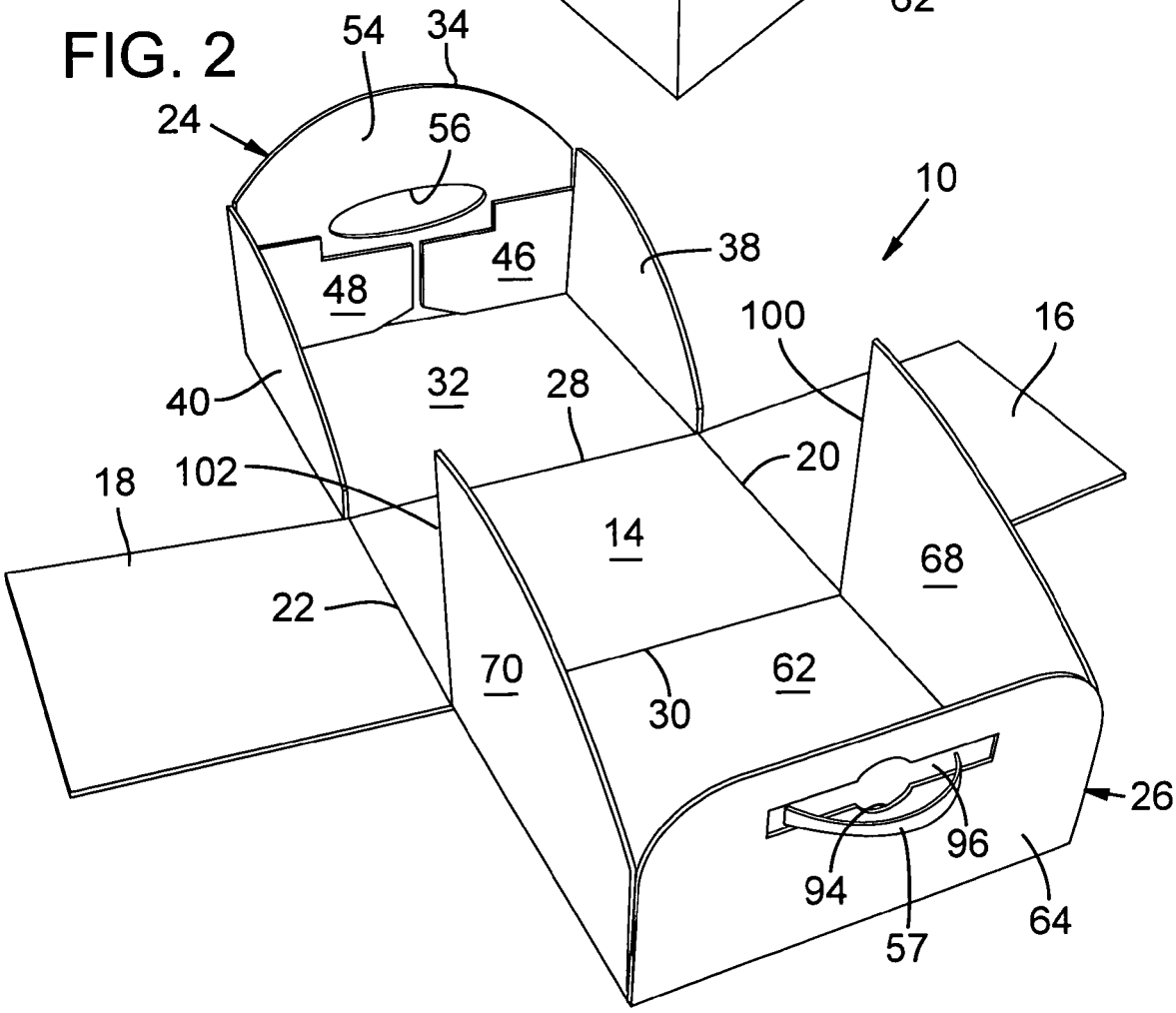
FIG. 2 is a perspective view of the container of FIG. 1, fully opened.
Figure 3:
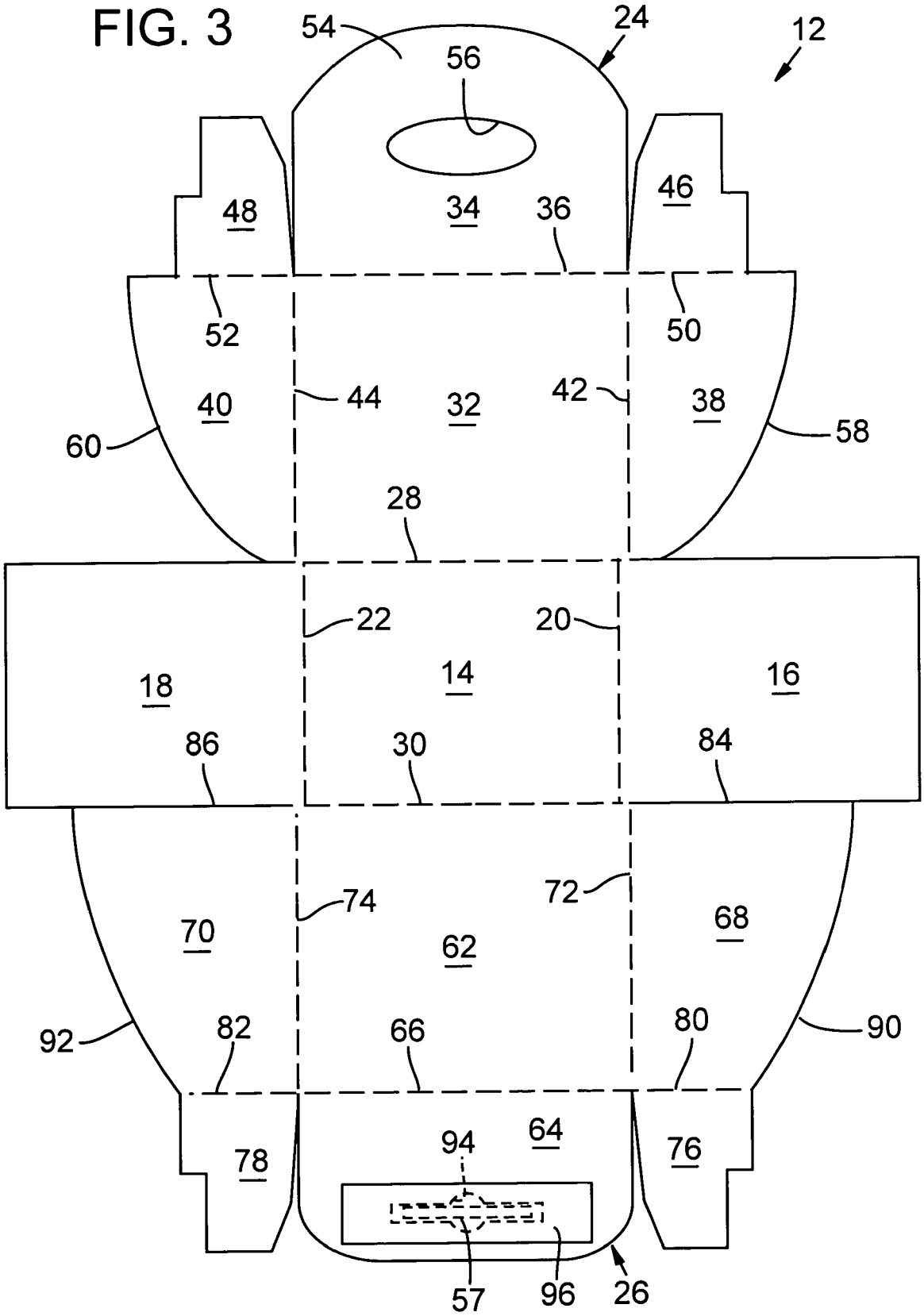
FIG. 3 is a plan view of the inner surface of the blank used to form the container shown in FIG. 1.

As shown in FIGS. 2 and 3, container 10 desirably is formed from a unitary, corrugated blank 12 (FIG. 3), having a bottom wall, or panel, 14. In other embodiments, blank 12 can be made from non-corrugated materials. Blank 12 defines two side walls, or panels, 16, 18, foldable along fold lines 20, 22, respectively. Side walls 16, 18 in the illustrated configuration have a height substantially equal to the height of the closed container. Alternatively, side walls 16, 18 can be dimensioned to have a height that is less than the height of the closed container. Bottom wall 14 is dimensioned to substantially coincide with the dimensions of the paper sheets of the stack 11 (e.g., 8½×11, A-4, 11×17 or 8½×14 sized paper, see FIG. 6) or some multiple number of stacks, such as 2 or 4 paper stacks. First and second shell portions 24, 26, respectively, are foldable relative to the bottom wall 14 along fold lines 28, 30, respectively. Shell portions 24, 26 are pivotable about their respective fold lines 28, 30 between a closed position (FIG. 1) and an open position (FIGS. 2 and 6) to allow paper to be removed from the container 10.

As best shown in FIG. 3, the first shell portion 24 comprises a main panel 32, and a top panel 34 foldable relative to the main panel along fold line 36 extending along the top edge of the main panel 32. In addition, two side flaps, or panels, 38, 40, are defined relative to the main panel 32 along fold lines 42, 44, respectively, extending along respective side edges of the main panel 32. The top panel 34 desirably is formed with an opening, or aperture, 56 that is dimensioned to permit a handle 57 to extend therethrough when the shell portions 24, 26 are in the closed position (FIG. 1). Two minor flaps 46, 48 are connected to side flaps 38, 40, respectively, in a foldable manner along fold lines 50, 52, respectively.

As used herein, a portion of the container 10 that is "connected to" another portion of the container can mean that such portions are formed from a unitary blank and defined by a fold line in the blank (such as minor flap 46 and side flap 38), or that such portions are separately formed and subsequently directly or indirectly joined to each other.

The second shell portion 26 comprises a main panel 62, and a top panel 64 connected to the main panel 62 along fold line 66 extending along the top edge of the main panel 64. Two side flaps, or panels, 68, 70 are connected to the main panel 62 along fold lines 72, 74, respectively, extending along respective side edges of the main panel 62. Two minor flaps 76, 78 are connected to side flaps 68, 70, respectively, along fold lines 80, 82, respectively. The blank 12 is formed with cuts 84 and 86 to separate side walls 16, 18 from side flaps 68, 70, respectively.

In the configuration illustrated by FIGS. 1-6, side flaps 38, 40 are formed with rounded or curved edges 58, 60, respectively, and side flaps 68, 70 are similarly formed with rounded, or curved, edges 90, 92, respectively (as best shown in FIG. 3). In addition, side flaps 38, 40 are tapered from the top panel 34 to the bottom wall 14. This configuration is advantageous in that it provides an unobstructed path to the side of the paper stack 11 adjacent shell portion 24 (FIG. 6) when removing paper from a position at the same level as or below the container (e.g., if the container is stored on an overhead shelf). Bottom edges 100, 102 (FIG. 2) of side flaps 68, 70 desirably extend substantially across the entire depth of the closed container 10 (i.e., the distance between panels 32 and 62 when the shell portions 24, 26 are in the closed position) to limit the ingress of moisture or other elements into the closed container. Also, side flaps 68, 70 are tapered from the bottom wall 14 to the top panel 64 to provide greater accessibility to the side of the paper stack 11 adjacent shell portion 26.

In alternative embodiments, the side flaps 38, 40, 68, 70 can have other shapes and/or dimensions. For example, the side flaps 38, 40, 68 and 70 can be generally rectangular, with each side flap having a substantially constant width substantially equal to the width of side walls 16, 18. Alternatively, side flaps 38, 40, 68, and 70 can have straight, diagonally extending edges, instead of the rounded edges 58, 60, 90, and 92 shown in the illustrated embodiment. In another embodiment alternative, side flaps 68, 70 can be tapered from the top panel 64 to the bottom wall 14.

As shown in FIG. 3, fold line 20 is offset inwardly from fold lines 42 and 72 a distance that is substantially equal to the thickness of the blank 12, and fold line 22 is offset inwardly from fold lines 44 and 74 by substantially the same distance. In this manner, when side walls 16, 18 are folded to be substantially perpendicular to the bottom wall 14 and the shell portions 24, 26 are pivoted to the closed position, the side walls 16, 18 will be internal to the shell portions 24, 26 and adjacent the stack 11.

To assemble the first shell portion 24, side flaps 38, 40 and top panel 34 are folded approximately 90° along their respective fold lines so that side flaps 38, 40 and top panel 34 extend substantially perpendicularly from the plane defined by main panel 32, as shown in FIG. 2. Minor flaps 46, 48 are folded inwardly toward each other. In particular embodiments, minor flaps 46, 48 may be secured to the inner surface 54 of the top panel 34, such as with a suitable adhesive, to rigidly secure side flaps 38, 40 to the top panel 34. Alternatively, minor flaps may be secured to the top panel 34 using tape, mechanical fasteners (e.g., staples), or by tab-and-slot connections, in which, for example, tabs formed on minor flaps 46, 48, extend into corresponding slots in the top panel 34.

The second shell portion 26 is assembled in a similar manner by folding side flaps 68, 70 and top panel 64 approximately 90° along their respective fold lines so that side flaps 68, 70 and top panel 64 extend substantially perpendicularly from the main panel 62, as best shown in FIG. 5. Minor flaps 76, 78 are folded inwardly toward each other and may be secured to the inner surface 88 of the top panel 64 to rigidly secure side flaps 68, 70 to the top panel 64.

Top panel 64 of the second shell portion 26 is formed with an opening 94 (FIGS. 1-3). In representative working embodiments, a backing piece 96 is secured to an inner surface 88 of top panel 64 using, for example, a suitable adhesive (as best shown in FIG. 5). Handle 57 is secured at its ends (e.g., using a suitable adhesive) to the backing piece 96 and extends upwardly through opening 94. Alternatively, the handle 57 can be secured directly to the top surface of top panel 64. Handle 57 desirably is sized to permit a gloved hand to be inserted through the space between the handle 57 and the top panel 64.

Handle 57 can be made from any of various materials. In particular embodiments, for example, handle 57 comprises a flexible strap made from a polymeric material, a piece of rope, or a piece of tape, although other suitable materials also can be used. Desirably, the handle 57 is designed to permit level stacking of containers. To this end, handle 57 may be made from a flexible material. Moreover, handle 57 may be substantially flat, i.e., having first and second major planar surfaces that extend substantially parallel to a surface defined by top panel 34 when container 10 is assembled and closed.

To package a paper stack 11 in the container 10, the stack is placed in the open container. For most paper, stack 11 is inserted such that the short ends of the stack are adjacent side walls 16, 18. The side walls 16, 18 are then folded, or pivoted, upwardly to be substantially perpendicular to the bottom wall 14 such that the side walls 16, 18 are in a face-to-face relationship with the short sides of the stack 11 (FIG. 6). With the side walls 16, 18 in their upwardly extending positions, the shell portions 24, 26 are folded, or pivoted, upwardly toward each other to the closed position, as depicted in FIG. 1. This brings main panels 32, 62 into a substantially perpendicular relationship relative to the bottom wall 14 and in a face-to-face relationship with the long sides of the paper stack 11. Side flaps 68, 70 of the second shell portion 26 extend over side walls 16, 18, respectively, and the side flaps 38, 40 of the first shell portion extend over side flaps 68, 70 (as best illustrated in FIG. 4). In addition, the top panel 34 of the first shell portion 24 is folded over the top panel 64 of the second shell portion 26. This allows handle 57 to extend upwardly through opening 56 formed in top panel 34 (FIG. 1). In this manner, main panels 32 and 62 serve as container side walls and top panels 34, 64 serve as the container top. Overlapping side flaps 38, 68 and overlapping side flaps 40, 70 serve as container side walls extending between main panels 32, 62. Internal side walls 16, 18 provide additional structural rigidity to side flaps 38, 68 and side flaps 40, 70, respectively.

As shown in FIG. 1, with reference to disclosed working embodiments, when container 10 is closed, handle 57 is positioned at the geometric center of the top of the closed container to permit gravity-centered lifting or carrying of the container by the handle 57 using only one hand. Of course, the handle 57 also could be positioned other than at a central location.

As mentioned above, bottom wall 14 in the illustrated configuration is dimensioned to substantially coincide with the dimensions of a paper stack 11 or perhaps multiples thereof. Thus, when the container 10 is closed, side walls 16, 18 abut the short sides of the paper stack 11 and main panels 32, 62 abut the long sides of the paper stack to substantially preclude the paper stack from shifting during shipping or handling of the container. With this arrangement, misalignment of the paper and damage to the edges of the paper caused during shipping or handling of container 10 can be substantially avoided. Although less desirable, in other embodiments, the container 10 could be dimensioned to provide spacing between the sides of the paper stack and inside surfaces of the container.

To keep shell portions 24, 26 from separating during shipping, an adhesive (e.g., glue) can be applied between side flaps 38 and 68, between side flaps 40 and 70, and/or between top panel 34 and top panel 64. Advantageously, the use of an adhesive between overlapping portions of container 10 allows the container to be easily opened without using any tools (e.g., a box cutter, scissors or equivalent devices), as further described below. In alternative embodiments, a plastic strap or an adhesive tape wrapped around the shell portions 24, 26 can be used in addition to, or instead of, an adhesive applied between adjacent portions of container 10 to keep the shell portions from separating during shipping.

Container 10 can be easily opened to gain access to the paper stacked inside by separating overlapping side flaps 38 and 68, overlapping side flaps 40 and 70, and overlapping top panels 34 and 64, and then pivoting the shell portions 24, 26 away from each other to fully expose two opposing sides of the paper stack 11 (as shown in FIG. 6). In this manner, the entire stack 11, or a portion thereof, can be easily removed from container 10 using both hands and transferred to, for example, a copy machine, while maintaining the alignment of the individual sheets. If a portion of paper stack 11 is removed, side walls 16, 18 substantially maintain the end-to-end alignment of any paper remaining in the open container. However, if desired, the side walls 16, 18 can be folded downwardly to fully expose all four sides of the stack 11, thereby allowing paper to be removed with two hands from either the short sides or the long sides of the stack 11. As can be appreciated, container 10 is much easier to use than conventional packaging that does not allow access to opposing sides of a paper stack.

In an alternative embodiment, container 10 can be provided with score lines coinciding with fold lines 50, 52, 80, and 82 so that side flaps 38, 40 can be separated from top panel 34 and side panels 68, 70 can be separated from top panel 64. Once separated, side flaps 38, 40, 68, 70 and top panels 34, 64 can be folded downwardly to provide even greater access to the paper stack.

Opening the illustrated container 10 does not destroy the integrity of the container structure. Consequently, the container can be reused for refilling, shipping, and/or storage. Although not required, shell portions 24, 26 can be provided with some structure useful for joining shell portions 24 and 26, such as a tab-and-slot locking mechanism to assist in retaining the shell portions in the closed position once the container has been initially opened and the adjacent surfaces of the shell portions are no longer adhesively secured to each other. Such a tab-and-slot locking mechanism may comprise a tab formed on one of the shell portions and a corresponding slot formed on the other shell portion. The tab is configured to be insertable into the corresponding slot when shell portions 24, 26 are pivoted to the closed position. The engagement of the tab and the slot assists in retaining the shell portions in their overlapping closed position.

Container 10 can be made from any suitable material, such as corrugated or non-corrugated fiberboard or polymeric materials, cardboard, or paperboard. Also, a moisture resistant coating can be provided on the inner surfaces of the container 10 to limit the ingress of moisture into the closed container. For example, a polymeric coating, such as HYDRABAN 1000AF™ manufactured by Michelman, Inc. of Cincinnati, Ohio, may be used to form the moisture resistant coating. Alternatively, a wax coating may be provided on the inner surfaces of the container, or a laminated liner, such as FIBER-LAM POLYCORR™ liner, manufactured by Fiber-Lam, Inc. of Doswell, Va., may be used.

Container 10 can be made using any convenient method. In one approach, for example, a unitary blank 12 (e.g., a cardboard blank) is cut using, for example, a machine having die cut capabilities (e.g., a rotary die cutter) to provide the configuration shown in FIG. 3. Fold lines 20, 22, 28, 30, 36, 42, 44, 50, 52, 66, 72, 74, 80, 82 can be formed in the blank 12 using conventional techniques. After the fold lines are formed, the shell portions 24, 26 are assembled by folding side flaps 38, 40, 68, 70, minor flaps 46, 48, 76, 78, and top panels 34, 64 along their fold lines in the manner described above, and securing, such as by gluing, minor flaps 46, 48 to top panel 34 and gluing minor flaps 76, 78 to top panel 64.

The moisture resistant coating, such as HYDRABAN 1000AF™, can be applied using conventional techniques, such as with a curtain coater or a doctor blade. In addition, the moisture resistant can be applied before or after the blank 12 is fabricated.

If desired, a removable, pressure sensitive label 98 can be provided on the outside of container 10, such as shown in FIG. 1. Label 98 can be used for a variety of purposes. For example, label 98 can display the trademark, design or name of the manufacturer of the paper that is packaged in the container. The user of the paper therefore has the option of removing the label 98 so that container 10 can be reused in commerce without the container being so marked.

The configuration of container 10 is not limited to the illustrated embodiment. Accordingly, numerous modifications and alterations to the illustrated embodiment are possible. For example, in alternative embodiments, selected portions of the container 10 (e.g., side walls 16, 18 or shell portions 24, 26) can be separately formed and then subsequently joined to respective edges of the bottom wall 14 to form the container 10. In addition, selected portions of container 10 can be formed from two or more layers of material (e.g., two layers of fiberboard secured to each other using, for example, adhesive or mechanical fasteners) to provide additional structural rigidity to that portion of the container.

In another embodiment, container 10 can be configured with the side walls 16, 18 joined to the long sides of the bottom wall 14 and the shell portions 24, 26 joined to the short sides of the bottom wall 14. In this embodiment, when the container is closed, side walls 16, 18 abut the long sides of the paper stack and the main panels 32, 62 abut the short sides of the paper stack.

In still another embodiment, container 10 can be formed without side walls 16, 18. With this embodiment, side flaps 68, 70 can be positioned to abut adjacent sides of the paper stack 11 to prevent side-to-side shifting of the paper stack during shipping or handling of container 10.

In yet another embodiment, side walls 16, 18 can be rigidly secured to the bottom wall 14 in a substantially perpendicular relationship relative to the bottom wall 14. In this embodiment, side walls 16, 18 cannot be folded downwardly away from the stack.

In another embodiment, container 10 can be formed with one or two additional internal side walls positioned in a face-to-face relationship with the long sides of paper stack 11 and extending substantially perpendicularly to side walls 16, 18 to maintain side-to-side alignment of the paper sheets when the container is opened. Such side walls may be configured to be pivotable relative to the bottom wall, such as side walls 16, 18.

In another embodiment, side flaps 68, 70 can be permanently secured (e.g., using an adhesive or mechanical fasteners) to side walls 16, 18, respectively, so that shell portion 26 is permanently retained in the closed position. Shell portion 24 is pivotal downwardly and upwardly to open and close container 10, respectively.

Further, container 10 can be provided with additional handles and/or alternative handle configurations. For example, two or more handles can be coupled, or otherwise secured to, one or both of the top panels 34, 64. Alternatively, one or more handles can be coupled, or otherwise secured to, other portions of the container, such as the bottom wall 14, main panels 32, 62, side flaps 38, 40, or side flaps 68, 70.

In another embodiment, a handle is provided in the form of a flexible strap wrapped around the container so as to extend around the top, bottom, and two opposing sides of the container. Desirably, such a strap includes two handles integrally formed in the strap and is positioned to coincide with the lateral or longitudinal mid-line of the top of the container to permit gravity-centered lifting. Alternatively, handles can be integrally formed in top panels 34, 64.

Figure 7:
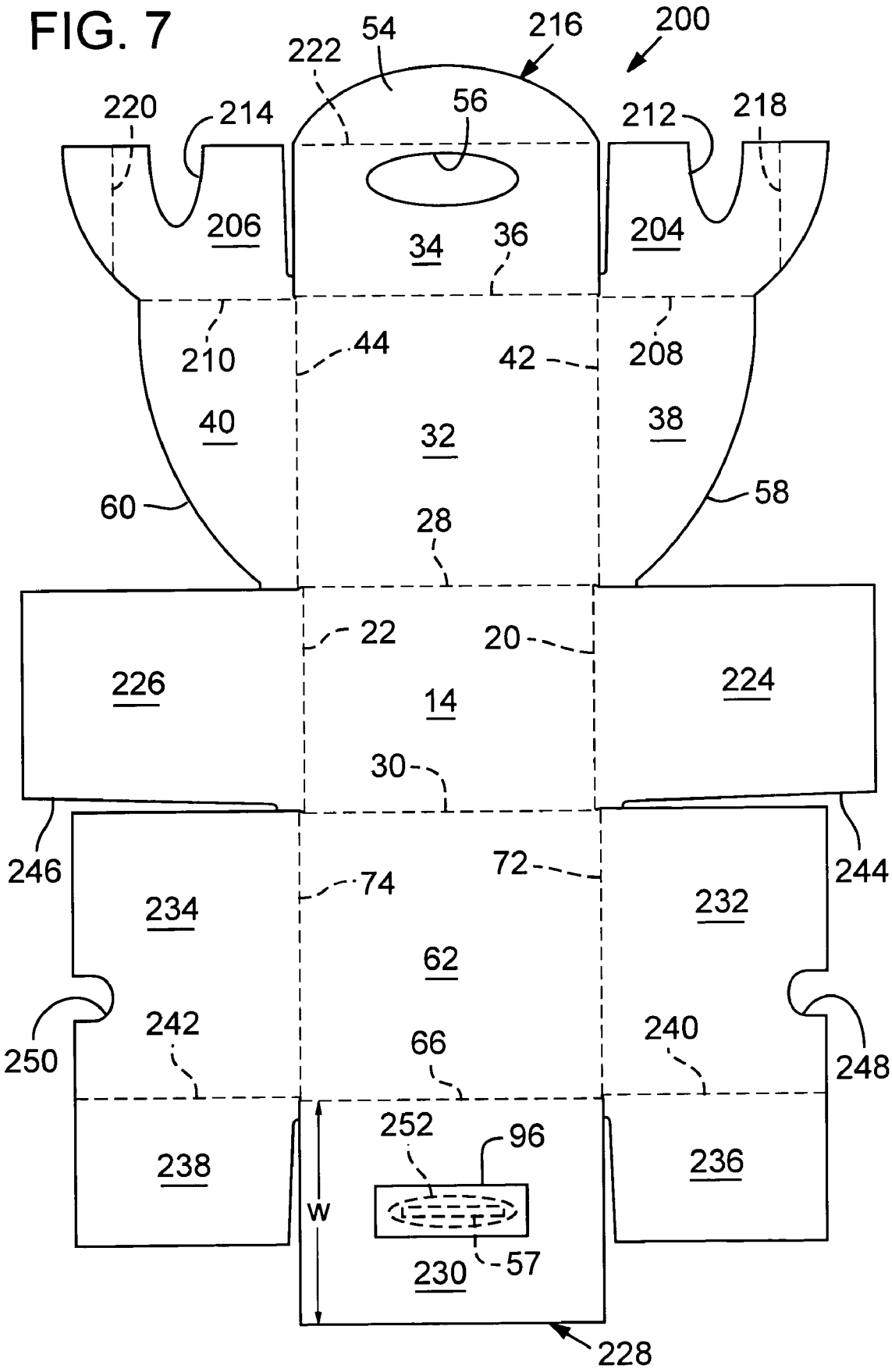
FIG. 7 is a plan view of the inner surface of a blank used to form another representative embodiment of the present container.
Figure 8:
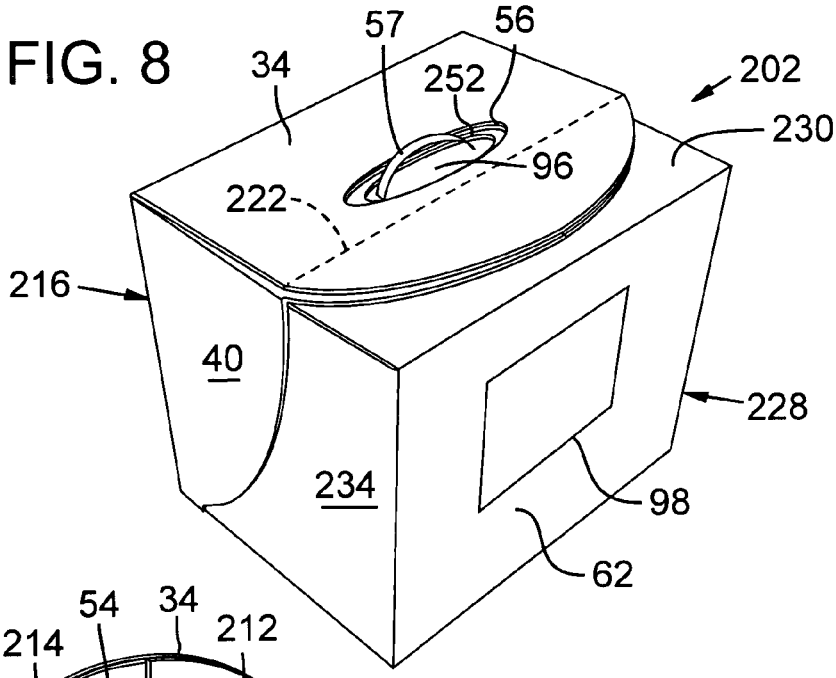
FIG. 8 is a perspective view of the container formed from the blank shown in FIG. 7.
Figure 9:
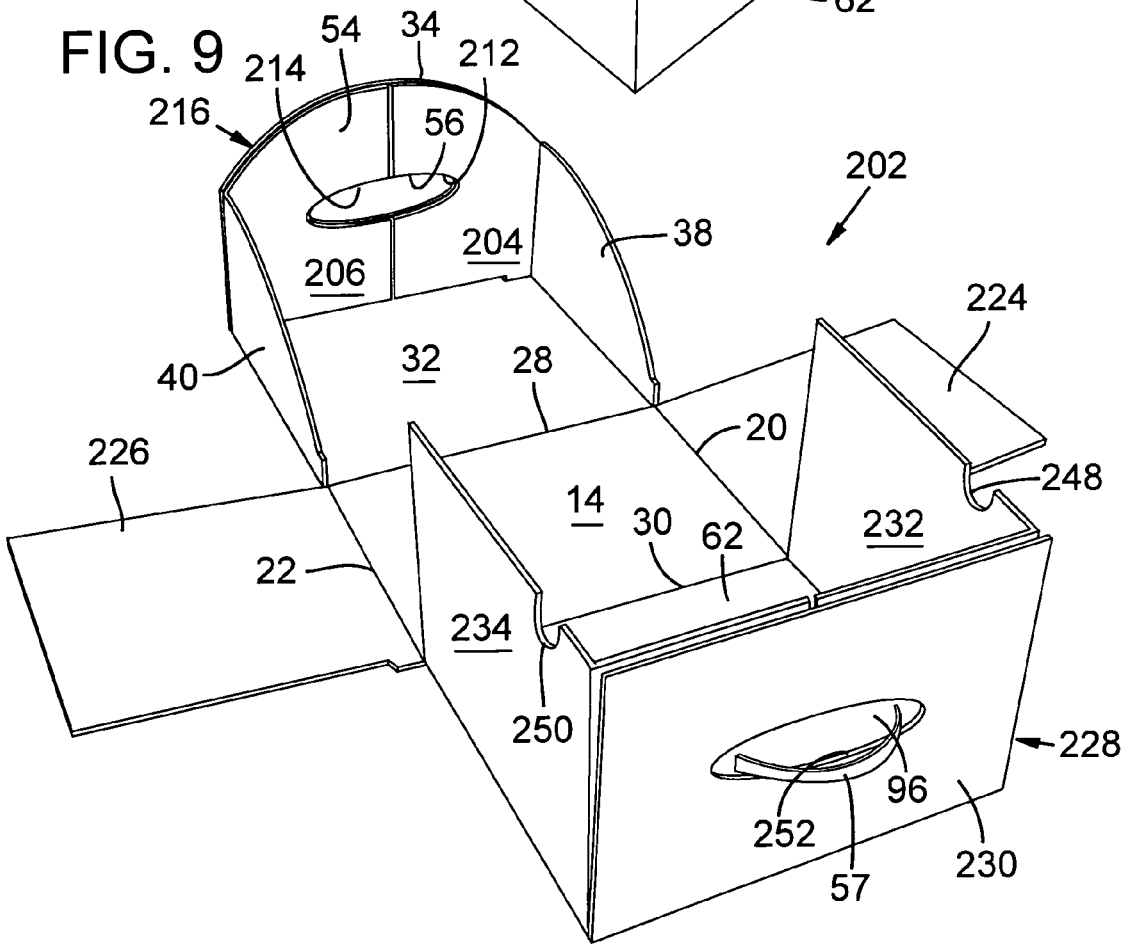
FIG. 9 is a perspective view of the container of FIG. 8, fully opened.

FIG. 7 shows another embodiment of a blank 200. FIG. 8 shows a container 202 in a closed position that is formed from blank 200. FIG. 9 shows the container 202 in a fully open position. Blank 200 and container 202 share many of the same elements as blank 12 and container 10 of FIGS. 1-6. Hence, elements in FIGS. 7-9 that are identical to corresponding elements in FIGS. 1-6 have the same respective reference numerals and are not described further.

As shown in FIG. 7, blank 200 has two minor flaps 204 and 206 that are connected to side flaps 38, 40, respectively, in a foldable manner along fold lines 208, 210, respectively. Minor flaps 204, 206 are formed with respective notches 212 and 214. As shown in FIG. 9, when side flaps 38, 40 and minor flaps 204, 206 are folded to form a first shell portion 216 of the container 202, notches 212, 214 align with opening 56 in the top panel 34. Minor flaps 204, 206 and top panel 34 can be formed with respective fold lines 218, 220, and 222 (FIG. 7), which align with each other when shell portion 216 is assembled. Fold lines 218, 220, 222 allow the curved portions of the top panel 34 and minor flaps 204, 206 to be folded away from top panel 230. These fold lines make opening a container 202 that has been glued shut more convenient because a user can use the curved portions of the top panel 34 and minor flaps 204, 206 as a handle to pull open the first shell portion 216.

Blank 200 also has two side walls, or panels, 224, 226, foldable along fold lines 20, 22, respectively. A second shell portion 228 of blank 200 comprises top panel 230, and two side flaps, or panels 232, 234. Two minor flaps 236, 238 are connected to side flaps 232, 234, respectively, along fold lines 240, 242, respectively. Side panels 224, 226 are formed with edges 244, 246, respectively, which extend from a point adjacent side flaps 232, 234, respectively, in an outwardly tapered direction relative to side flaps 232, 234 to provide a clearance between side panels 224, 226 and side flaps 232, 234, respectively.

Although not required, in the illustrated embodiment, side flaps 232, 234 are formed with notches 248, 250, respectively, to facilitate rapid packaging of a stack of paper in the container 202 with a case packing machine. More specifically, notches 248, 250 are positioned to allow arms of a case packing machine to hold side panels 224, 226 against the sides of a stack of paper as shell portion 228 is folded upwardly around side panels 224, 226.

Top panel 230 desirably has a width w (FIG. 7) that is equal to or slightly less than the width of the container 202 in its closed position (i.e., the distance between main panels 32, 62 when the container is closed). Advantageously, this prevents creasing or embossing of a paper stack in the container 202 when multiple containers 202 are stacked on top of each other during shipping or storage.

As discussed above, an exemplary use of the embodiments disclosed herein is for containing cut sheets of paper. In one specific construction, a container (e.g., container 10 or container 202) is dimensioned to contain 2 reams of paper and is constructed from a corrugated fiberboard blank having an inner liner, an outer liner, and a fluting material disposed between and adhesively secured to the inner and outer liners. In this construction, the inner liner comprises 35# paper, the corrugated material comprises 26# fluting, and the outer liner comprises 36# paper. In another construction, a container dimensioned to contain 3 reams of paper is constructed from a corrugated blank having a 56# inner liner, a 26# fluting, and a 36# outer liner. In another construction, a container dimensioned to contain 4 reams of paper is constructed from a corrugated blank having a 56# inner liner, a 26# fluting, and a 69# outer liner. In yet another construction, a container dimensioned to contain 5 reams of paper is constructed from a corrugated blank having a 56# inner liner, a 26# fluting, and a 36# outer liner.

EXAMPLES

The following examples are provided solely to illustrate certain features of working embodiments. A person of ordinary skill in the art will recognize that the scope of the invention is not limited to the illustrated features.

Example 1

In this example, moisture absorption tests were performed on four different types of corrugated fiberboard, each having two paper liners and fluting material disposed between and adhesively secured to the liners. The material tested included the following: (1) corrugated fiberboard comprising a 38# first paper liner, a 23# fluting material, and a 56# second paper liner; (2) corrugated fiberboard comprising a 56# first paper liner, a 26# fluting material, and a 69# second paper liner; (3) corrugated fiberboard comprising a 36# first paper liner, a 26# fluting material, and a 35# second paper liner; (4) corrugated fiberboard comprising and a 36# first paper liner, 26# fluting material, and a 35# second paper liner with a X-300 moisture-resistant coating (available from Michelman, Inc.).

Multiple samples of each material measuring 2.5 inches in diameter were cut from sheets of each corrugated material and weighed. About 250 grams of calcium sulfate ($CaSo_4$) were placed in each of multiple glass jars. Each sample was placed on top of an open jar and secured in place by a metal ring to create a hermetic seal. The samples were then placed in an incubator operating at 38° C.+/−2° C. and 78%+/−2% relative humidity. The samples were removed from the incubator and weighed after two, seven, and fifteen days. The initial weight of each sample and the weight after each time interval are provided in Tables 1a-1d below.

Figure 10:
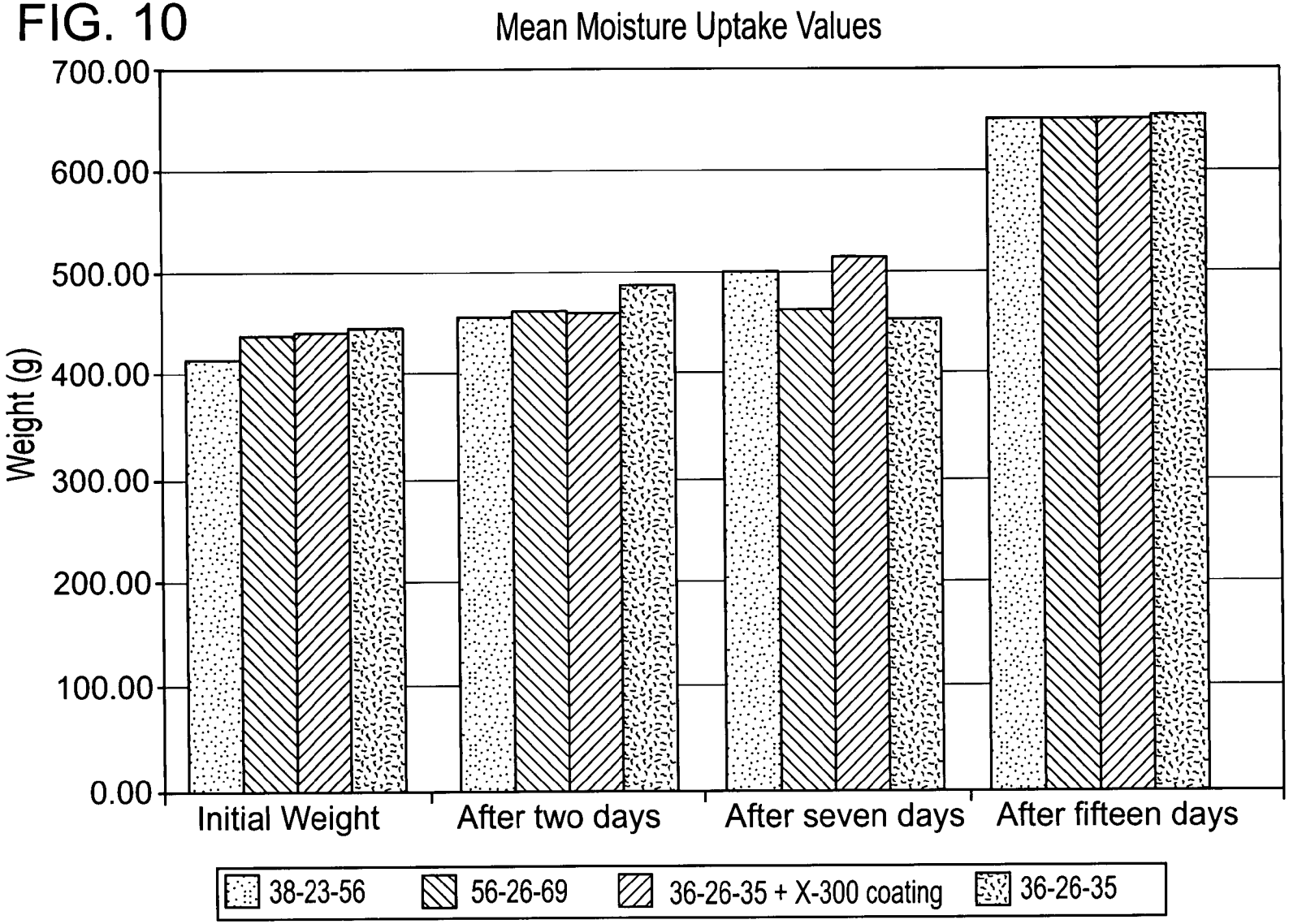
FIG. 10 is a bar graph illustrating the mean moisture uptake values for four different constructions of corrugated fiberboard.
Figure 11:
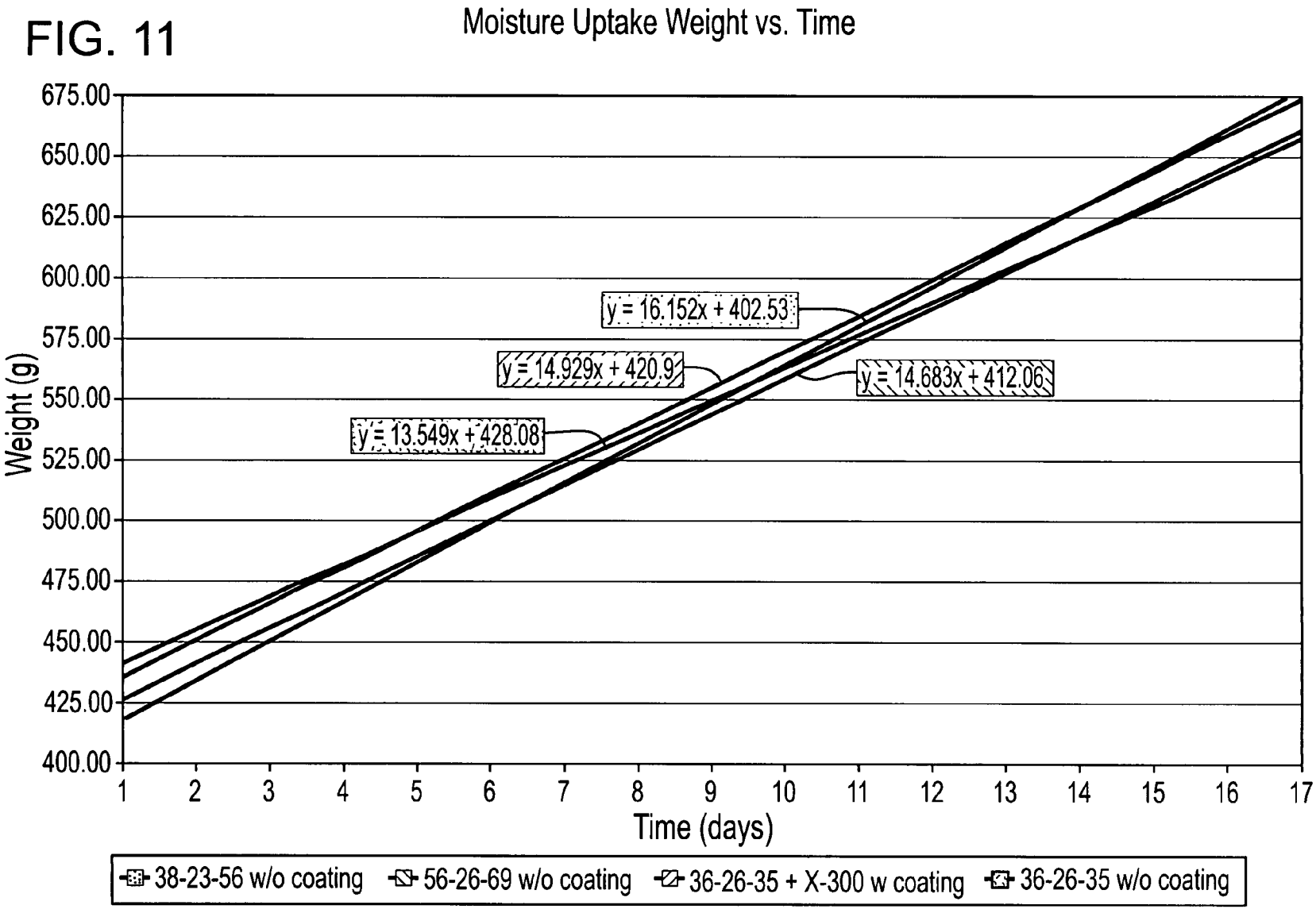
FIG. 11 shows a best-fit line graph of mean moisture uptake as a function of time for each of the four corrugated fiberboard constructions.

FIG. 10 is a bar graph of the mean moisture uptake values in Tables 1a-1d for each type of material. FIG. 11 shows a best fit straight line of mean moisture uptake as a function of time for each material determined from the values in Tables 1a-1d. As shown in FIG. 11, the 38#-23#-56# corrugated fiberboard absorbed moisture at a rate of about 16.152 g/day; the 56#-26#-69# corrugated fiberboard absorbed moisture at a rate of about of about 14.683 g/day; the 36#-26#-35# corrugated fiberboard with a moisture-resistant coating absorbed moisture at a rate of about 14.929 g/day; and the 36#-26#-35# corrugated fiberboard without a moisture-resistant coating absorbed moisture at a rate of about 13.549 g/day.

TABLE 1a (samples of 38#-23#-56# corrugated fiberboard)

| Sample number | Initial weight (g) | Weight after two days (g) | Weight after seven days (g) | Weight after fifteen days (g) |
|---|---|---|---|---|
| 1 | 444.30 | 474.30 | 533.12 | 667.3 |
| 2 | 437.47 | 476.24 | 554.46 | 668.5 |
| 3 | 396.79 | 459.80 | 496.04 | 668.5 |
| 4 | 392.10 | 448.69 | 461.52 | 670.4 |
| Mean | 417.67 | 464.76 | 511.29 | 668.68 |

TABLE 1b (samples of 56#-26#-69# corrugated fiberboard)

| Sample number | Initial weight (g) | Weight after two days (g) | Weight after seven days (g) | Weight after fifteen days (g) |
|---|---|---|---|---|
| 1 | 466.75 | 469.30 | 470.34 | 668.3 |
| 2 | 446.50 | 450.77 | 473.69 | 669.2 |
| 3 | 411.50 | 489.66 | 493.79 | 668.3 |
| mean | 441.58 | 469.91 | 479.27 | 668.6 |

TABLE 1c (samples of 36#-26#-35# corrugated fiberboard with coating)

| Sample number | Initial weight (g) | Weight after two days (g) | Weight after seven days (g) | Weight after fifteen days (g) |
|---|---|---|---|---|
| 1 | 433.50 | 468.31 | 536.76 | 669.8 |
| 2 | 434.44 | 451.02 | 496.74 | 669.5 |

TABLE 1c-continued (samples of 36#-26#-35# corrugated fiberboard with coating)

| Sample number | Initial weight (g) | Weight after two days (g) | Weight after seven days (g) | Weight after fifteen days (g) |
|---|---|---|---|---|
| 3 | 449.00 | 472.28 | 527.53 | 666.6 |
| 4 | 433.70 | 466.25 | 496.47 | 667.2 |
| 5 | 469.11 | 482.37 | 548.80 | 668.6 |
| mean | 443.95 | 468.05 | 521.26 | 668.34 |

TABLE 1d (samples of 36#-26#-35# corrugated fiberboard without coating)

| Sample number | Initial weight (g) | Weight after two days (g) | Weight after seven days (g) | Weight after fifteen days (g) |
|---|---|---|---|---|
| 1 | 448.64 | 500.00 | 502.25 | 669.4 |
| 2 | 458.20 | 520.00 | 356.55 | 672.3 |
| 3 | 450.81 | 512.70 | 512.21 | 675.4 |
| 4 | 434.00 | 477.00 | 508.69 | 668.6 |
| mean | 447.91 | 502.43 | 469.93 | 671.43 |

Example 2

In this example, drop, compression and vibration tests were conducted on three differently sized containers 202 made from corrugated fiberboard containing respective stacks of paper. The first container had a length of 12", a width of 9", and a height of 11⅜", and weighed 26.4 lbs. (with paper). The second container had a length of 12", a width of 9", and a height of 7⅛", and weighed 15.7 lbs. (with paper). The third container had a length of 12", a width of 9", and a height of 5", and weighed 10.9 lbs. (with paper). The shell portions of the containers were glued together to retain the containers in their closed positions during testing.

Testing was conducted in accordance with the ASTM D4169 Standard Practice for Performance Testing of Shipping Containers and Systems, Distribution Cycle 3, Assurance Level II. In addition, testing was conducted at 73.4+/−2° C. and 50%+/−2% relative humidity.

In a first test, the containers were dropped from the platen of a LAB free fall drop tester (the first container was dropped from a height of 13" and the second and third containers were dropped from a height of 15"). Each container was dropped once on its top, once on each bottom edge, once on a bottom corner, once on a diagonally opposite bottom corner, and once on its bottom.

In a second test, each container was placed on the bottom platen of a Tinius Olsen Compression Tester. To apply a load to each container, the top platen was operated to move downwardly at a speed of ½ inches per minute. The tester applied loads of 1,569 lbs., 1,556 lbs., and 1,572 lbs. to the first, second, and third containers, respectively.

In a third test, the containers were placed on the table of a TMI rotary vibration machine in their normal upright shipping position. The machine was activated and the speed was increased to about 250 rpm. The containers were vibrated at this frequency for 30 minutes. Each container was then re-positioned so as to lie on a respective side wall, vibrated for 15 minutes at 250 rpm, re-positioned again so as to lie on a respective end wall, and vibrated again for 15 minutes at 250 rpm.

In a fourth test, the containers were placed in their normal upright position on the table of a MTS 840 vibration machine. Fences were placed around the containers to prevent the containers from vibrating off the table (the fences did not restrict vertical motion of the containers). The containers were subjected to the "Random" test option for 20 minutes. Each container was then re-positioned so as to lie on a respective side wall, vibrated for 20 minutes, re-positioned again so as to lie on a respective end wall, and vibrated again for 20 minutes.

In a fifth test, the containers were dropped from the platen of the free fall drop tester (as in the first test, the first container was dropped from a height of 13" and the second and third containers were dropped from a height of 15"). In this test, each container was dropped once on a vertical edge, once on a side face, once on an adjacent end face, once on a top corner, once on an adjacent top edge, and finally once on its bottom from twice the specified height (i.e., 26" for the first container and 30" for the second and third containers).

After subjecting the containers to the foregoing tests, each container showed signs of wear and tear, but the integrity of each container was unaffected.

Example 3

In this example, several containers containing paper placed were subjected to various conditions in a temperature chamber to demonstrate the moisture transfer rate (MVTR) capabilities of the containers. The types of containers used in this example included a container having a construction similar to container 202 of FIGS. 8 and 9 and two commercially available containers. Prior to testing, the containers were prepared as described in Table 2 below.

Figure 12:
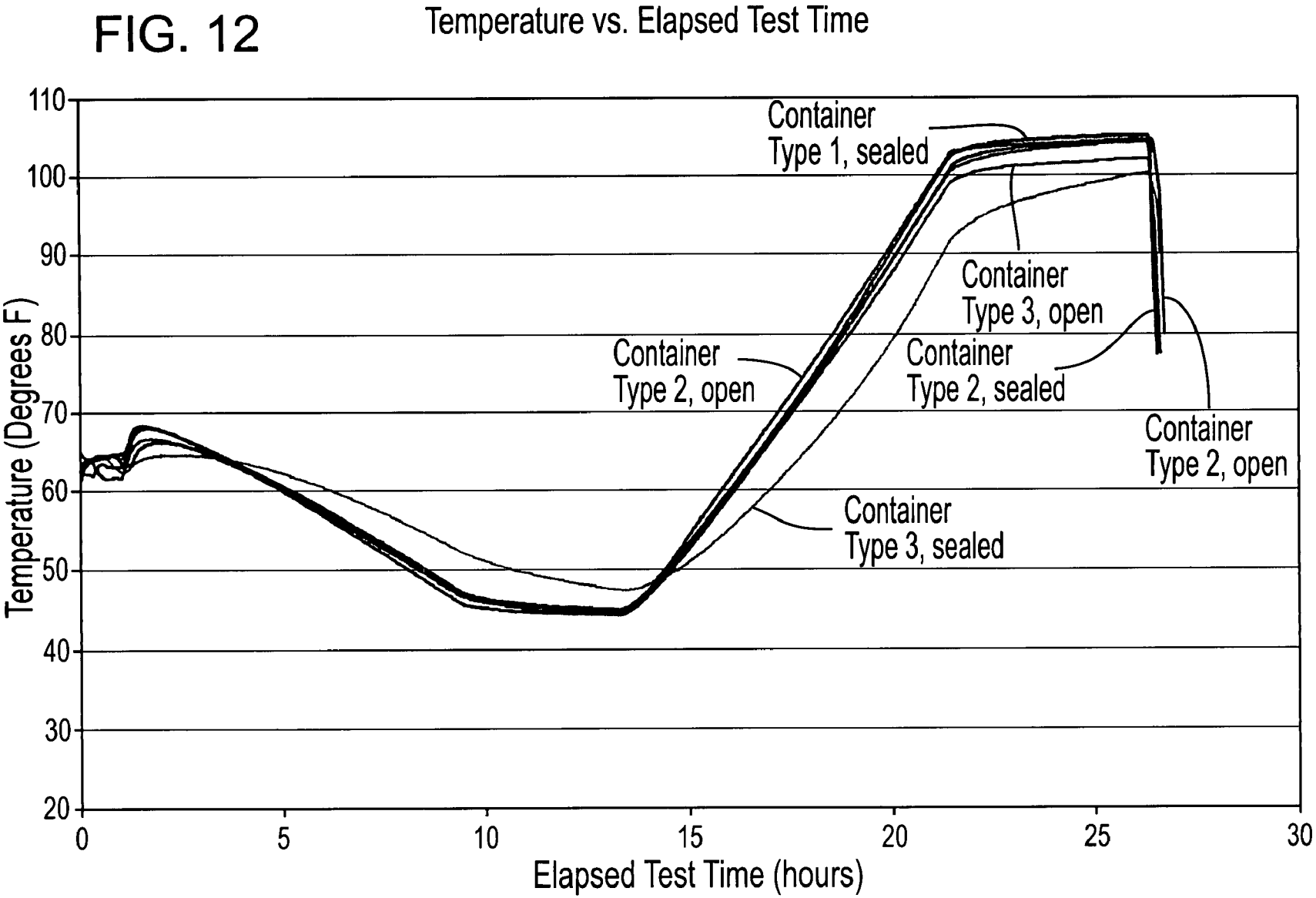
FIG. 12 is a graph showing the temperature measured inside several containers inside a temperature chamber.
Figure 13:
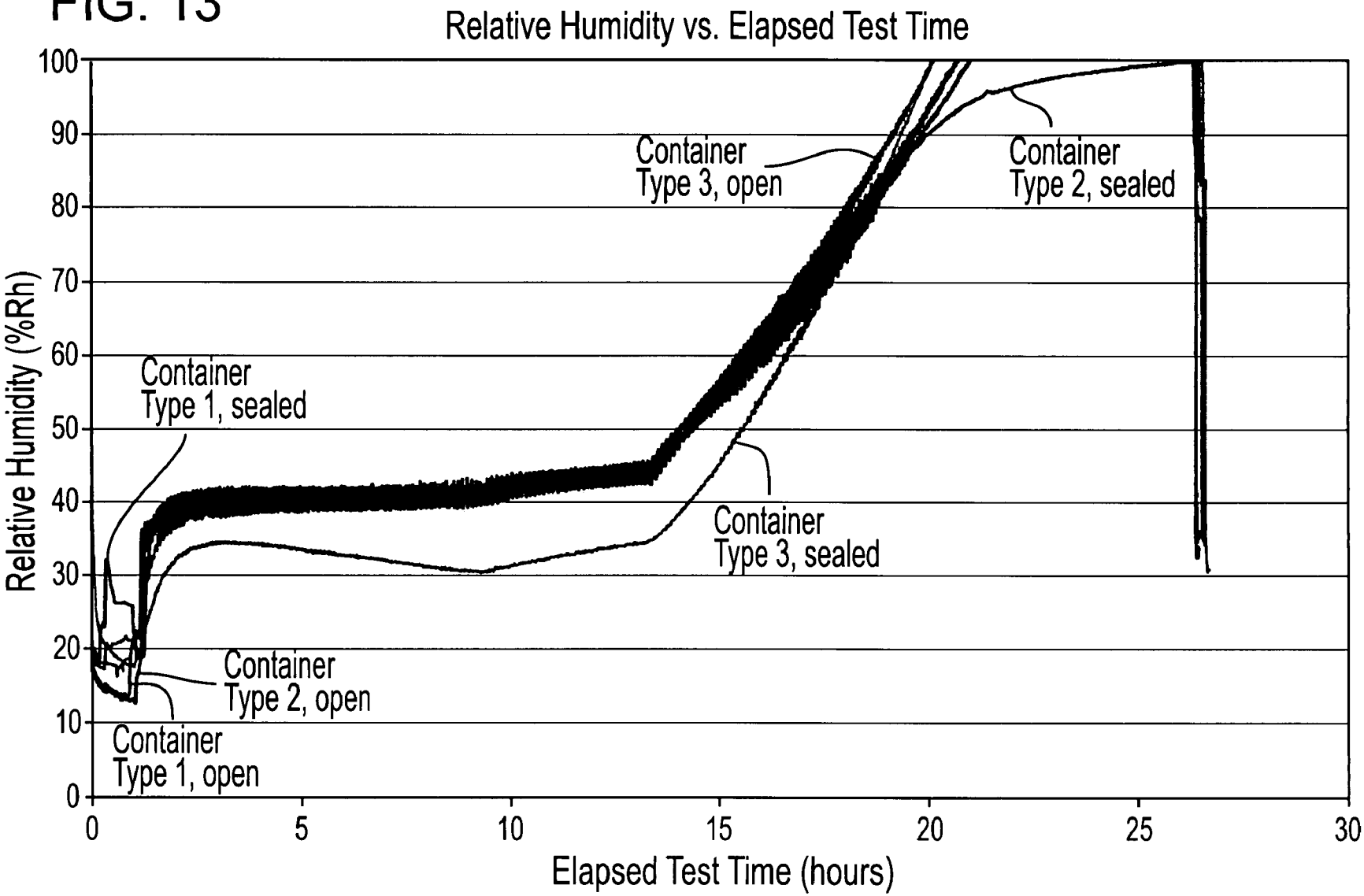
FIG. 13. is a graph showing the humidity measured inside several containers inside a temperature chamber.

The containers were placed in a temperature chamber, which was operated to cool to 45° F. from ambient at 60% relative humidity over 8 hours, soak at 45° F. and 60% relative humidity for 4 hours, warm to 104° F. at 90% humidity over 8 hours, and then soak at 104° F. and 90% relative humidity for 4 hours. FIGS. 12 and 13 show the temperature and relative humidity, respectively, measured inside the containers having temperature and humidity probes while the containers were in the temperature chamber. After removing the containers from the temperature chamber, the paper was removed from the containers and subjected to a runnability test in a copier and several printers, as described in Table 3. Table 4 shows the results of the runnability test. As shown in Table 4, there were no paper jams or misfeeds caused by the paper from any of the containers.

TABLE 2

| Container Type | Container Configuration | | | |
|---|---|---|---|---|
| Container type #1 | 1 container sealed in production configuration (as shipped), with temperature and humidity probes sealed inside | 1 container opened and re-closed, without glue to simulate storage capability, with temperature and humidity probes sealed inside | 5 containers sealed in production configuration (as shipped) without temperature and humidity probes | 5 containers opened and re-closed, without glue to simulate storage capability, without temperature and humidity probes sealed inside |
| Container type #2 | 1 container sealed in production configuration (as shipped), with temperature and humidity probes sealed inside | 1 container opened and re-closed, without glue to simulate storage capability, with temperature and humidity probes sealed inside | 5 containers sealed in production configuration (as shipped) without temperature and humidity probes | 5 containers opened and re-closed, without glue to simulate storage capability, without temperature and humidity probes sealed inside |
| Container type #3 | 1 container sealed in production configuration (as shipped), with temperature and humidity probes sealed inside | 1 container opened and re-closed, without glue to simulate storage capability, with temperature and humidity probes sealed inside | 5 containers sealed in production configuration (as shipped) without temperature and humidity probes | 5 containers opened and re-closed, without glue to simulate storage capability, without temperature and humidity probes sealed inside |

TABLE 3

| Copier/Printer Type | Sheet Quantity |
|---|---|
| Xerox 5800 | 2500 sheets from each product; 625 sheets side A, 625 sheets side B, 625 sheets sides A/B, 625 sheets sides B/A. |
| Hewlett-Packard Laser Jet 4 (short feed) | 2000 sheets from each container type; 500 sheets side A, 500 sheets side B, 500 sheets sides A/B, 500 sheets sides B/A. |
| Hewlett-Packard Laser Jet 4MV (long feed) | 2000 sheets from each container type; 500 sheets side A, 500 sheets side B, 500 sheets sides A/B, 500 sheets sides B/A. |
| Hewlett-Packard Laser Jet 5Si (long feed) | 2000 sheets from each container type; 500 sheets side A, 500 sheets side B, 500 sheets sides A/B, 500 sheets sides B/A. |
| Hewlett-Packard Laser Jet 6P (short feed) | 2000 sheets from each container type; 500 sheets side A, 500 sheets side B, 500 sheets sides A/B, 500 sheets sides B/A. |

TABLE 4

| Container type | HP LaserJet 4 | HP LaserJet 4MW | HP LaserJet 5Si | HP LaserJet 6P | Xerox 5800 |
|---|---|---|---|---|---|
| Container type 1, open | 0 jams or misfeeds | 0 jams or misfeeds | 0 jams or misfeeds | 0 jams or misfeeds | 0 jams or misfeeds |
| Container type 1, sealed | 0 jams or misfeeds | 0 jams or misfeeds | 0 jams or misfeeds | 0 jams or misfeeds | 0 jams or misfeeds |
| Container type 2, open | 0 jams or misfeeds | 0 jams or misfeeds | 0 jams or misfeeds | 0 jams or misfeeds | 0 jams or misfeeds |
| Container type 2, sealed | 0 jams or misfeeds | 0 jams or misfeeds | 0 jams or misfeeds | 0 jams or misfeeds | 0 jams or misfeeds |
| Container type 3, open | 0 jams or misfeeds | 0 jams or misfeeds | 0 jams or misfeeds | 0 jams or misfeeds | 0 jams or misfeeds |
| Container type 3, sealed | 0 jams or misfeeds | 0 jams or misfeeds | 0 jams or misfeeds | 0 jams or misfeeds | 0 jams or misfeeds |

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

We claim:

1. A container for containing a stack of paper, comprising:

a bottom wall defining first and second pivotable shell portions:

the first and second shell portions being pivotable between a closed position for containing the stack of paper for shipping or storing and open position, in which at least two opposing sides of the stack are exposed to facilitate removal of paper from the container; and opposed first and second side walls, each extending upwardly from first and second edges, respectively, of the bottom wall in a substantially perpendicular relationship relative to the bottom wall when the container is closed;

the first shell portion comprising a main panel pivotally connected at a bottom edge thereof to a third edge of the bottom wall, a top panel extending from a top edge of the main panel, and first and second, spaced apart side panels, each extending from a respective side edge of the main panel; and the second shell portion comprising a main panel pivotally connected at a bottom edge thereof to a fourth edge of the bottom wall, a top panel extending from a top edge of the main panel of the second shell portion, and first and second, spaced apart side panels, each extending from a respective side edge of the main panel of the second shell portion;

whereby when the shell portions are in the closed position, each of the side panels of the first shell portion extends in an overlapping relationship with one of the side panels of the second shell portion and with the first and second side walls extending upwardly from the first and second edges of the bottom wall;

wherein each side panel of the first shell portion has a respective flap that is folded inwardly against and adhesively secured to the top panel of the first shell portion to maintain the side panels in a perpendicular relationship with respect to the main panel and the top panel of the first shell portion; and wherein each side panel of the second shell portion has a respective flap that is folded inwardly against and adhesively secured to the top panel of the second shell portion to maintain the side panels in a perpendicular relationship with respect to the main panel and the top panel of the second shell portion.

2. The container of claim 1, wherein the shell portions are configured to completely enclose the stack of paper when the shell portions are in the closed position.

3. The container of claim 1, wherein the first and second side walls extending upwardly from the first and second edges of the bottom wall are pivotable relative to the bottom wall so that the side walls can be pivoted downwardly and away from each other to facilitate removal of paper from the container.

4. The container of claim 1, wherein the first and second side walls extending upwardly from the first and second edges of the bottom wall have a height that is substantially equal to the height of the container.

5. The container of claim 1, wherein the first and second shell portions form the sides and top of the container when the shell portions are in the closed position.

6. The container of claim 1, wherein:

the shell portions are retained in the closed position by an adhesive applied between the top panel of the first shell portion and the top panel of the second shell portion.

7. The container of claim 1, further comprising a handle coupled to one of the first and second shell portions to facilitate lifting and/or carrying of the container when the shell portions are in the closed position.

8. The container of claim 7, wherein the handle is located at the geometric center of the top of the container when the shell portions are in the closed position.

9. The container of claim 7, wherein the handle is coupled to the top panel of one of the shell portions and is positioned to extend through a corresponding opening in the top panel of the other shell portion when the shell portions are in the closed position.

10. The container of claim 7, wherein the handle comprises a flexible strap.

11. The container of claim 1, wherein:

when the shell portions are in the closed position, the top panel of the first shell portion extends over the top panel of the second shell portion, the top panel of the first shell portion having parallel side edges and a curved forward edge extending between respective ends of the side edges.

12. The container of claim 1, wherein the bottom wall, the first shell portion and the second shell portion are formed from a unitary blank of material.

13. The container of claim 1, wherein the container is made of corrugated fiberboard.

14. The container of claim 13, wherein the container comprises at least a 36# outer liner, at least a 26# fluting, and at least a 35# inner liner.

15. The container of claim 13, wherein the fiberboard has a mean moisture uptake of less than about 16 g/day over 15 days at about 38° C. and about 75% relative humidity.

16. A container for containing a stack of paper, comprising a bottom wall defining first and second pivotable shell portions, the first and second shell portions being pivotable between a closed position for containing the stack of paper for shipping or storing and open position, in which at least two opposing sides of the stack are exposed to facilitate removal of paper from the container;

the first shell portion comprising a main panel pivotally connected at a bottom edge thereof to a first edge of the bottom wall, a top panel extending from a top edge of the main panel, and first and second, spaced apart side panels, each extending from a respective side edge of the main panel; and the second shell portion comprising a main panel pivotally connected at a bottom edge thereof to a second edge of the bottom wall, a top panel extending from a top edge of the main panel of the second shell portion, and first and second, spaced apart side panels, each extending from a respective side edge of the main panel of the second shell portion;

whereby when the shell portions are in the closed position, each side panel of the first shell portion extends in an overlapping relationship with one of the side panels of the second shell portion;

wherein the shell portions are retained in the closed position by an adhesive applied between each side panel of the first shell portion and one of the side panels of the second shell portion.

17. A container for containing one or more articles, comprising:

a bottom;

first and second side walls extending upwardly from respective edges of the bottom, the first side wall being opposite the second side wall, the first and second side walls extending substantially the entire height of the container; and first and second shell portions, each connected in a pivotable manner to a respective edge of the bottom, the shell portions being pivotable toward each other to a closed position for containing the articles therebetween for shipping or storing the articles, the shell portions also being pivotable away from each other to cause the container to be open at two opposing sides of the container to facilitate removal of articles from the container;

each shell portion having a respective main panel and respective first and second side panels extending therefrom such that, when the shell portions are pivoted to the closed position, each side panel of the first shell portion extends in an overlapping relationship with one of the side panels of the second shell portion and one of the side walls, the container having a width extending between the main panels;

the first and second side panels of the first shell portion extending substantially the entire height of the container;

the first and second side panels of the second shell portion extending substantially the entire height of the container and less than the width of the container, the first and second side panels of the second shell portion extending outside of the first and second side panels of the first shell portion when the shell portions are in the closed position;

wherein each of the first and second side panels of the second shell portion has a width that tapers in a direction extending from a top edge of each side panel to a bottom edge of each side panel;

wherein each of the first and second side panels of the second shell portion has a convex curved edge extending in a direction from its top edge to its bottom edge and tapers from a maximum width at its top edge to a minimum width adjacent its bottom edge.

18. The container of claim 17, wherein the shell portions are configured to substantially enclose the side walls when the shell portions are pivoted to the closed position.

19. The container of claim 17, wherein each shell portion has a respective top panel being configured such that, when the shell portions are pivoted to the closed position, the top panels extend in an overlapping relationship relative to each other to form the top of the container.

20. The container of claim 19, wherein a handle for carrying the container is coupled to one of the top panels and is positioned to extend through a corresponding opening in the other top panel when the shell portions are in the closed position.

21. A blank for forming a container for containing paper, comprising:

a bottom panel dimensioned to support a stack of paper;

a first shell portion extending from a first edge of the bottom panel;

a second shell portion extending from a second edge of the bottom panel, opposite the first shell portion;

the shell portions being configured such that, when the container is formed from the blank, the shell portions are pivotable relative to the bottom panel between a closed position for containing the stack of paper for shipping or storing and open position, in which at least two opposing sides of the stack are exposed to facilitate removal of paper from the container, at least the first shell portion having a top panel for forming at least a portion of the top of the container;

a first side wall extending from a third edge of the bottom panel; and a second side wall extending from a fourth edge of the bottom panel, opposite the first side wall;

each of the first and second side walls having opposing side edges that are separated from the first and second shell portions to permit folding of the first and second side walls relative to the bottom panel to upright positions extending perpendicularly to the bottom panel when the container is formed from the blank;

the first shell portion defining a main panel extending from the bottom panel and first and second spaced apart side panels, each extending from a respective side edge of the associated main panel; and the second shell portion defining a main panel extending from the bottom panel and first and second spaced apart side panels, each extending from a respective side edge of the associated main panel;

wherein the main panel and the first and second side panels of each shell portion are formed without slits or openings.

22. The blank of claim 21 comprising a unitary piece of material.

23. The blank of claim 21 wherein:

the top panel extends from the main panel of the first shell portion for forming at least a portion of the top of the container; and the second shell portion defines a top panel extending from the main panel of the second shell portion for forming at least a portion of the top of the container;

the shell portions being configured such that, when the container is formed from the blank and the shell portions are in the closed position, the top panels extend in an overlapping relationship relative to each other to form the top of the container.

24. The blank of claim 23 wherein:

the shell portions are configured such that, when the container is formed from the blank and the shell portions are in the closed position, each side panel of the first shell portion extends in an overlapping relationship relative to one of the side panels of the second shell portion to form opposing sides of the container.

25. The blank of claim 23 wherein a handle is coupled to one of the top panels.

26. The blank of claim 23 wherein a handle is coupled to the top panel of one of the shell portions and is positioned to extend through a corresponding opening in the top panel of the other shell portion when the shell portions are in the closed position.

27. The blank of claim 21 wherein:

each side panel of the shell portions has a width extending in a direction from the main panel of the first shell portion to the main panel of the second shell portion when the container is formed from the blank and the shell portions are in the closed position;

the first and second side walls each have a height that is greater than the widths of the side panels of the shell portions.

28. A blank for forming a container for containing one or more articles, comprising:

a bottom panel;

first and second side walls extending from respective edges of the bottom panel, the first side wall being opposite the second side wall, the side walls being foldable relative to the bottom panel, each side wall having a height that extends substantially the entire height inside the container formed from the blank; and first and second shell portions extending from respective edges of the bottom panel, the first shell portion being opposite the second shell portion, each shell portion has a main panel, a top panel, and first and second side panels;

wherein when the container is formed from the blank, the shell portions are pivotable relative to the bottom panel toward each other to a closed position for containing the articles therebetween for shipping or storing the articles, the shell portions also being pivotable away from each other to cause the container to be open at two opposing sides of the container to facilitate removal of articles from the container;

wherein the first and second side walls and the main panel, top panel, and side panels are formed without any slits or openings.

29. The blank of claim 28 wherein each side wall has a width that extends substantially the entire width inside the container formed from the blank.

30. A container for containing a stack of paper, comprising:

a base;

a first shell portion having a first main panel extending away from the base, a first top panel extending from a top edge of the first main panel and having a handle, and first and second side flaps, each extending from a respective side edge of the first main panel and being adhesively secured in a perpendicular relationship to the first top panel, the first shell portion being connected at a bottom edge thereof to the base and pivotable between a closed position and an open position such that, when the first shell portion is in the closed position, the first main panel is adjacent to and covers one side of the stack, the first top panel is adjacent to and covers at least a portion of the top of the stack and each of the first and second side flaps are adjacent to and cover at least a portion of opposite ends of the stack;

a second shell portion being opposite the first shell portion, the second shell portion having a second main panel extending away from the base, a second top panel extending from a top edge of the second main panel and defining an opening, and third and fourth side flaps, each extending from a respective side edge of the second main panel and being adhesively secured in a perpendicular relationship to the second top panel, the second shell portion being connected at a bottom edge thereof to the base and pivotable between a closed position and an open position, such that when the second shell portion is in the closed position, the second main panel is adjacent to and covers one side of the stack, the second top panel overlaps the first top panel and the handle extends through the opening, the third side flap extends in an overlapping relationship with the first side flap and the fourth side flap extends in an overlapping relationship with the second side flap; and first and second side walls extending upwardly from the base, the first side wall being opposite the second side wall, wherein when the shell portions are in the closed position, the first and second side walls are disposed within the first and second shell portions, with the first side wall being interposed between the stack and the first and third side flaps and the second side wall being interposed between the stack and the second and fourth side flaps, the first and second side walls being pivotably connected to the base so that the side walls can be pivoted downwardly away from the stack when the shell portions are in the open position;

whereby when the shell portions are in the open position and the first and second side panels are folded downwardly away from the stack, all four sides of the stack are accessible to facilitate removal of paper from the container.

* * * * *